US006647626B2

(12) United States Patent
Nakano

(10) Patent No.: US 6,647,626 B2
(45) Date of Patent: Nov. 18, 2003

(54) ELECTRIC ROTARY SHAVER

(75) Inventor: Tsuyoshi Nakano, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 09/759,470

(22) Filed: Jan. 12, 2001

(65) Prior Publication Data

US 2002/0029479 A1 Mar. 14, 2002

(30) Foreign Application Priority Data

Aug. 11, 2000 (JP) ..... 2000-245069

(51) Int. Cl.[7] ..... B26B 19/14
(52) U.S. Cl. ..... 30/43.4; 30/43.5; 30/43.6
(58) Field of Search ..... 30/43.4, 43.5, 30/43.6, 346.51

(56) References Cited

U.S. PATENT DOCUMENTS

| | | | | | |
|---|---|---|---|---|---|
| 2,900,720 | A | * | 8/1959 | Starre et al. | 30/43.5 |
| 3,715,803 | A | | 2/1973 | Tyler | |
| 3,748,731 | A | * | 7/1973 | Kuiken et al. | 30/43.6 |
| 3,844,033 | A | * | 10/1974 | Yonkers | 30/43.5 |
| 3,913,225 | A | * | 10/1975 | Tietjens et al. | 30/43.6 |
| 4,001,932 | A | * | 1/1977 | Herrick | 30/43.5 |
| 4,038,748 | A | * | 8/1977 | Tyler | 30/43.6 |
| 4,077,120 | A | * | 3/1978 | Herrick et al. | 30/43.5 |
| 4,168,570 | A | * | 9/1979 | Bakker et al. | 30/43.6 |
| RE30,857 | E | * | 2/1982 | Tyler | 30/43.5 |
| 4,688,329 | A | * | 8/1987 | Oord | 30/43.6 |
| 5,012,577 | A | * | 5/1991 | Bosch | 30/43.6 |
| D326,739 | S | * | 6/1992 | Mauro | D28/50 |
| 5,131,148 | A | * | 7/1992 | Wahl | 30/346.51 |
| 5,625,950 | A | * | 5/1997 | Sterk et al. | 30/346.51 |
| 5,704,126 | A | * | 1/1998 | Franke et al. | 30/345.51 |
| 5,983,501 | A | * | 11/1999 | Izumi | 30/43.5 |
| 6,015,623 | A | * | 1/2000 | Wielstra | 30/43.6 |
| 6,145,200 | A | * | 11/2000 | Jorna et al. | 30/346.51 |
| 6,199,282 | B1 | * | 3/2001 | Uchiyama et al. | 30/43.6 |
| 6,226,870 | B1 | * | 5/2001 | Barish | 30/43.6 |
| 6,354,005 | B1 | * | 3/2002 | Bosch | 30/43.6 |
| 6,460,252 | B1 | * | 10/2002 | Nakano | 30/43.4 |
| 2002/0062565 | A1 | * | 5/2002 | Uchiyama et al. | 30/43.6 |
| 2002/0174546 | A1 | * | 11/2002 | Kawafune et al. | 30/43.6 |

FOREIGN PATENT DOCUMENTS

| | | | | |
|---|---|---|---|---|
| DE | 2413592 | * | 10/1974 | 30/43.5 |
| JP | 40-16116 | * | 6/1965 | 30/43.5 |
| WO | WO 96/26046 | | 8/1996 | |

* cited by examiner

*Primary Examiner*—Allan N. Shoap
*Assistant Examiner*—Jason Prone
(74) *Attorney, Agent, or Firm*—Koda & Androlia

(57) ABSTRACT

In an electric rotary shaver in which outer cutters are provided in outer cutter holes formed in a cutter frame so that the outer cutters can move in the axial direction and tilt in any desired direction with inner cutters disposed between the outer cutters and inner cutter drive shafts that are urged in the axial direction toward the outer cutter, the outer surfaces of the outer cutters and the inner surfaces of the outer cutter holes being caused to make a sliding contact so that the outer cutters tilt in any desired direction in the outer cutter holes. The circumference of each outer cutter is curved so as to snugly engage with the curved outer surface of each outer cutter hole.

5 Claims, 4 Drawing Sheets

ELECTRIC ROTARY SHAVER

BACKGROUND OF THE INVENTION

1. Field of the Invention

The present invention relates to an electric rotary shaver and more particularly to a structure for supporting outer cutters in a cutter frame of the electric rotary shaver.

2. Prior Art

FIG. 7 is a perspective view of the overall structure of a prior art electric rotary shaver. In this electric shaver 10, a cutter head 20 is detachably mounted on the upper portion of a main body case 12 of the shaver 10. Three outer cutters 22 are disposed in the cutter head 20 so that the centers of the outer cutters are at the positions of the vertices of an equilateral triangle. A plurality of slits for introducing whiskers are formed in the radial direction in the outer cutters 22. Furthermore, in each outer cutter 22, an annular outside hair introduction region V and an annular inside hair introduction region W are formed in a concentric configuration, and a groove is formed in the boundary area between the outside hair introduction region V and the inside hair introduction region W.

FIG. 8 shows the internal structure of the electric rotary shaver 10. The cutter head 20 is constructed from a cutter frame 30, metal outer cutters 22, outer cutter holders 24 which hold the outer cutters 22, metal inner cutters 26, inner cutter bases 28 that support the inner cutters 26, and cutter retaining plates 31 that hold the inner cutters 26 so that the inner cutters 26 are rotatable. The cutter frame 30, outer cutter holders 24, inner cutter bases 28 and cutter retaining plates 31 are all made of a synthetic resin. The outer cutters 22 are supported so that they are prevented from rotating relative to the outer cutter holders 24, thus ensuring that the outer cutters 22 do not rotate together with the inner cutters 26.

The reference numeral 32 is a cutter cradle that is installed to cover the opening of the main body case 12. Inner cutter drive shafts 34 that transmit the rotational driving force of a motor 50 to the inner cutters 26 protrude from the cutter cradle 32 so that the respective drive shafts 34 positionally correspond to the respective inner cutters 26. The inner cutter drive shafts 34 are provided so as to be coaxial with the inner cutter bases 28 and engage with the inner cutter bases 28 in a dovetail engagement so that each of the inner cutter drive shafts 34 rotates as a unit with the corresponding inner cutter base 28.

The reference numeral 36 is a spring that constantly urges the corresponding inner cutter drive shaft 34 upward. The outer cutters 22 are supported in a floating fashion by the springs 36 via the inner cutters 26, inner cutter bases 28 and inner cutter drive shafts 34.

The linkage of the inner cutter drive shafts 34 and motor 50 is accomplished by a structure in which engaging projections 38 disposed on the outer circumferences of the lower ends of the inner cutter drive shafts 34 engage with a plurality of shaft engaging portions 42 disposed in upright positions on the inner cutter drive gears 40, and the inner cutter drive gears 40 engage with a gear 52 fastened to the output shaft of the motor 50. The inner cutter drive shafts 34 are disposed so as to tilt in all directions with respect to the axial lines of the inner cutter drive gears 40.

As described above, the outer cutters 22 are supported while being biased by the springs 36 in a direction that causes the outer cutters 22 to protrude toward the outside, so that the outer cutters 22 is movable in and out of the outer cutter holders 24 and the outer cutters 22 can tilt within a specified angular range in all directions inside the outer cutter holders 24. Furthermore, as seen from FIG. 8, the outer cutters 22 are provided, together with the outer cutter holders 24, inside the outer cutter holes 44 formed in the cutter frame 30. The internal diameter of the outer cutter holes 44 is slightly larger than the external diameter of the outer cutters 22. Accordingly, the outer cutters 22 can move inward and outward along the axial lines of the outer cutter holes 44. Also, the outer cutters 22 can tilt within a specified angular range in all directions with respect to the axial direction of the outer cutter holes 44.

The outer cutters 22 are, as described above, supported, together with the outer cutter holders 24, in the cutter frame 30 so that the outer cutters 22 can tilt and also move inward and outward in the axial direction. Accordingly, during the use, the outer cutters 22 fit against the skin as a result of the appropriate inward and outward movement and tilting movement of the outer cutters 22 in arbitrary directions when the electric shaver is placed against the jaw or cheek, so that whiskers can be reliably shaved.

In the conventional electric shaver, as seen from the above, the fact that the outer cutters 22 can tilt relative to the cutter frame 30 results from the structure in which the internal diameter of the outer cutter holes 44 is slightly larger than the external diameter of the outer cutters 22, so that the resulting clearance allows the tilting.

However, there is a demand for a product that has an even greater tilting angle of the outer cutters 22 than a conventional product, so that shaving can be accomplished with the outer cutters 22 fitted more closely to the skin. One conceivable method of meeting this demand is to increase the clearance between the outer cutter holes 44 and the outer cutters 22 to a greater value than that used in the conventional electric shavers, thus increasing the tilting angles. However, an increase of the clearance between the outer cutter holes 44 and outer cutters 22 to a larger value makes it difficult to set the center positions of the outer cutters 22 because of looseness between the outer cutter holes 44 and outer cutters 22. Also, it destabilizes the rotation of the inner cutters 26. Furthermore, the outer cutters 22 tend to make a considerable movement inside the outer cutter holes 44, lowering the cutting efficiencies.

SUMMARY OF THE INVENTION

The present invention eliminates the above problems. The object of the present invention is to provide an electric rotary shaver with a good cutting efficiency in which the outer cutters are supported so as to move axially and tilt with respect to the cutter frame, and in which the outer cutters have an increased tilting angles compared to that in a conventional shaver, thus improving the fit of the outer cutters against the skin.

In order to accomplish the above-described object, the shaver of the present invention has the structure as described below.

More specifically, the shaver of the present invention comprises:

a cutter frame provided with outer cutter holes, and outer cutters each of which being fitted in each of the outer cutter holes so as to be movable in an axial direction thereof and tiltable in any desired direction with inner cutters provided between the outer cutters and inner cutter drive shafts, the drive shafts being urged toward outside in an axial direction thereof; and in the present invention, the outer surfaces of the outer cutters and the inner surfaces of the outer cutter holes are formed so as to make a sliding contact, thus supporting the outer cutters in the outer cutter holes so that the outer cutters can tilt in any desired direction.

In the present invention, the outer surfaces of the outer cutters and the inner surfaces of the outer cutter holes make a sliding contact at three or more points, thus supporting the outer cutters in the cutter frame with the outer cutters being tiltable in any desired direction.

Furthermore, in the present invention, the outer cutters make a sliding contact with the inner surfaces of the outer cutter holes so that the outer cutters are movable in the axial direction.

In addition, in the present invention, resin molded sections whose outer surfaces make the sliding contact with the inner surfaces of the outer cutter holes are integrally resin-molded on the outer cutters of the outer cutters.

In the present invention, further, the outer surfaces of the outer cutters are formed in a spherical surface shape that protrudes outward, ribs that make a sliding contact with the inner surfaces of the outer cutter holes are disposed on the outer surfaces of the outer cutters so that the ribs protrude form the outer surfaces, and the outer surfaces of the outer cutters have recessed surfaces that make a sliding contact with protruding portions formed on the inner surfaces of the outer cutter holes.

BRIEF DESCRIPTION OF THE DRAWINGS

FIG. 7 is a perspective view of an electric rotary shaver; and.

DETAILED DESCRIPTION OF THE INVENTION

Below, the preferred embodiments of the electric rotary shaver of the present invention will be described in detail with reference to the accompanying drawings. The characterizing feature of the electric rotary shaver of the present invention is a supporting method that supports the outer cutters in the cutter frame. Accordingly, the following descriptions will be made mainly with reference to the structure of supporting the outer cutters in the cutter frame.

Figure 7:
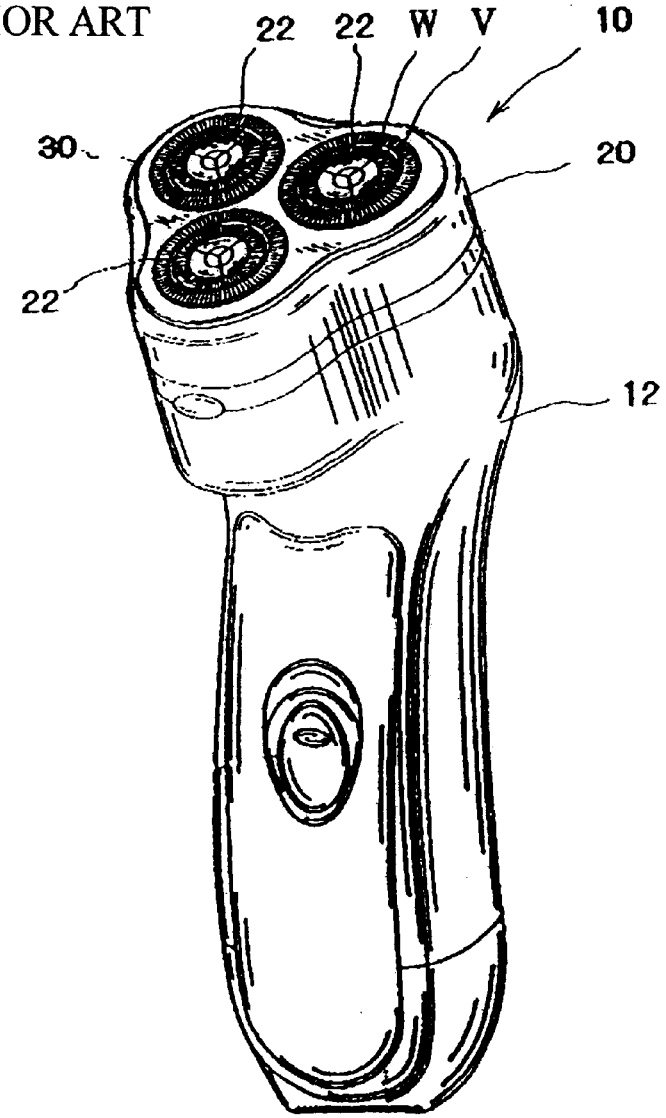
FIG. 7 PRIOR ART
Figure 8:
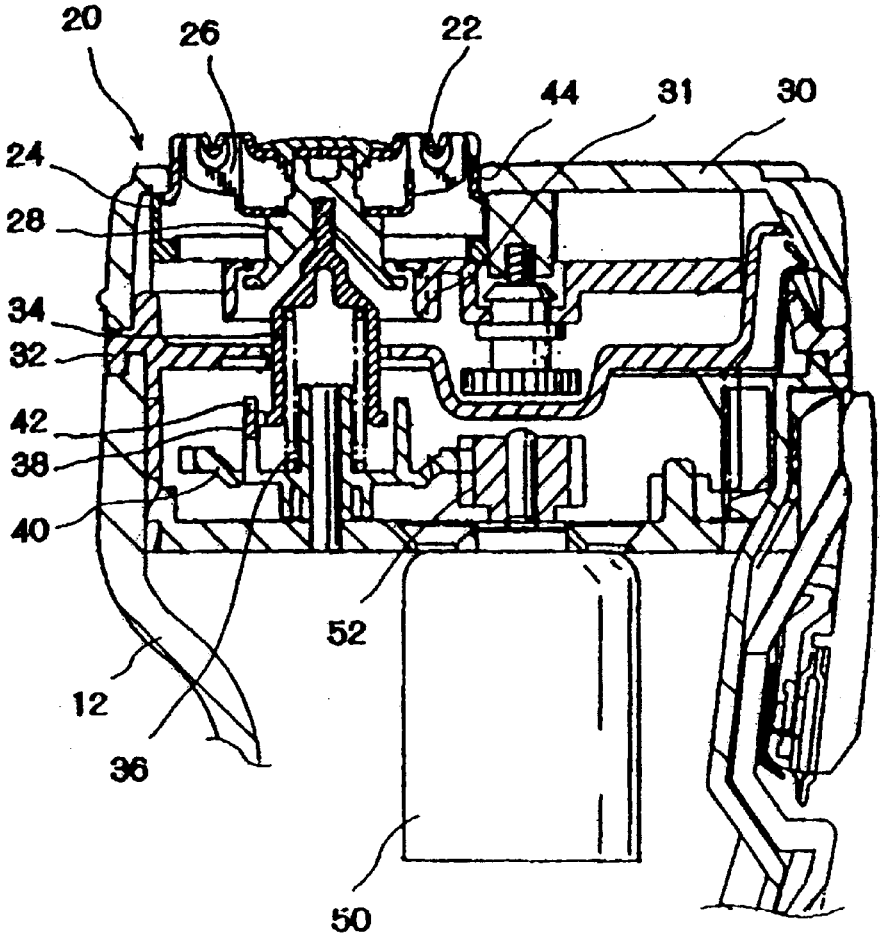
FIG. 8 PRIOR ART
FIG. 8 is a sectional illustration showing the internal structure of an electric rotary shaver.

The overall structure of the electric rotary shaver, the internal structure of the cutter head 20, and the structure of the driving mechanism of the inner cutters, etc. of the shown embodiments are the same as those used in the conventional electric rotary shaver of FIGS. 7 and 8. More specifically, the cutter head that is detachably mounted on the upper portion of the main body case is comprised of a cutter frame, outer cutters, outer cutter holders, inner cutters, inner cutter bases that support the inner cutters, and cutter retaining plates that rotatably hold the inner cutters. Also, the inner cutter drive shafts that are engaged coaxially with the inner cutter bases by a dovetail engagement are biased by springs so that the outer cutters are constantly urged toward the outside, and the outer cutters are supported in a floating fashion via the inner cutters, the inner cutter bases and inner cutter drive shafts. Furthermore, the inner cutter drive shafts are connected to a motor via inner cutter drive gears and a gear that is fastened to the output shaft of the motor, so that the inner cutters are rotationally driven.

Figure 1A:
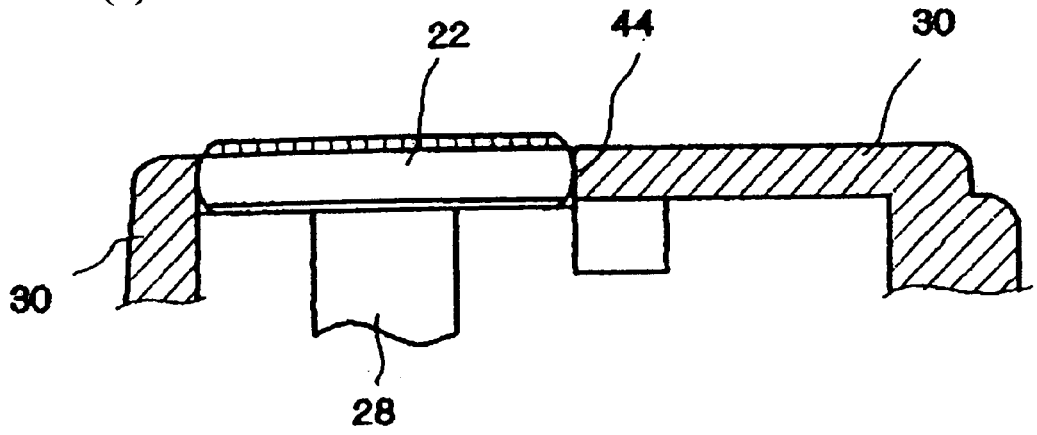
FIGS. 1(*a*) and 1(*b*) are explanatory diagrams that illustrate the structure of an outer cutter and a cutter frame in accordance to the first embodiment of the electric rotary shaver of the present invention.
Figure 1B:
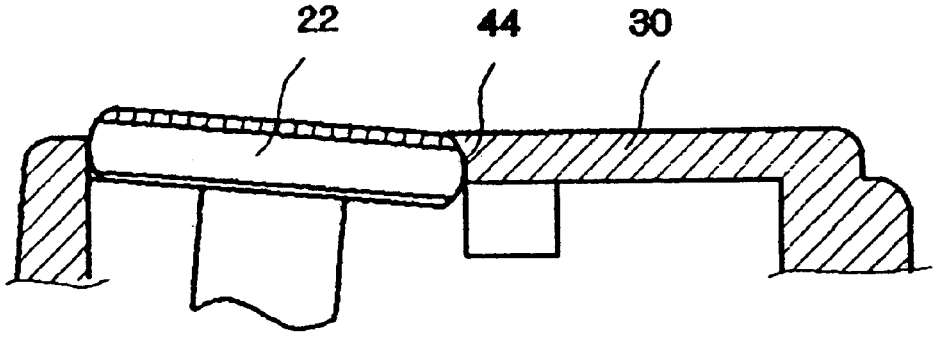

FIGS. 1(*a*) and 1(*b*) illustrate the structure used in the first embodiment of the present invention that supports the outer cutters 22 in the cutter frame 30 of the cutter head. The structure used to support the outer cutters 22 in this embodiment is characterized by the fact that the outer surfaces of the outer cutters 22 have spherical surfaces, and the inner surfaces of the outer cutter holes 44 of the cutter frame 30 have sliding contact surfaces that make a sliding contact with the outer surfaces of the outer cutters 22.

More specifically, as a result of forming the outer surfaces of the outer cutters 22 into spherical surfaces so as to make a sliding contact with the inner surfaces of the outer cutter holes 44, the outer cutters 22 can tilt in any desired direction within the sliding contact surfaces of the outer cutter holes 44. FIGS. 1(*a*) and 1(*b*) show one of the outer cutters 22 tilted. When the outer cutters 22 and the inner surfaces of the outer cutter holes 44 thus make a sliding contact along the spherical surface or a curved surface, the outer cutters 22 tilt with the center of the spherical surface as the center of rotation.

As shown in FIGS. 1(*a*) and 1(*b*), since the outer surface of the outer cutter 22 is formed as spherical surface and the outer cutter 22 is supported with the outer surface thereof being caused to make a sliding contact with the inner surface of the outer cutter hole 44 of the cutter frame 30, the outer cutter 22 is supported in the outer cutter hole 44 without any looseness; and even when the outer cutter 22 is greatly tilted, the outer cutter 22 is supported in a stable fashion in the cutter frame 30. Since the outer cutter 22 is supported in the cutter frame 30 in a stable fashion, the inner cutters can rotate smoothly, and a good cutting efficiency is assured.

Figure 2:
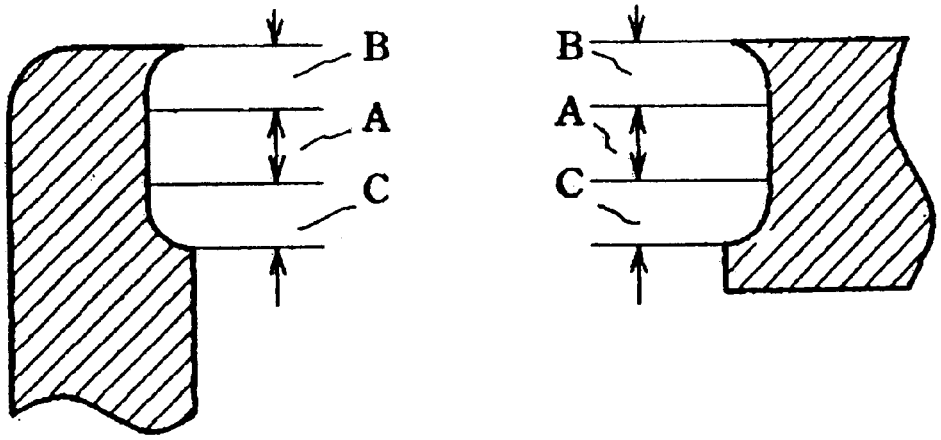
FIG. 2 is an enlarged sectional view of the shape of the inner surface of the outer cutter hole of the cutter frame.

It is necessary that the outer cutter 22 is not only tiltable inside the outer cutter holes 44 but also is urged in a direction to protrude toward the outside of the cutter frame 30 from the upper surface of the cutter frame 30 so that the outer cutter can move inward and outward in the axial direction. In this case, when the outer surface of the outer cutter 22 is formed as a spherical surface, and the inner surface of the outer cutter hole 44 is formed as a mere spherical surface that makes sliding a contact with the outer cutter 22, the movement of the outer cutters 22 in the axial direction is restrained. For this reason, it is advisable that as shown in FIG. 2 the intermediate area of the inner surface of the outer cutter hole 44 of the cutter frame 30 be formed as a cylindrical portion A and the areas above and below the cylindrical portion A be formed as spherical surface portions B and C.

In the cylindrical portion A formed in the inner surface of the outer cutter hole 44, the outer cutter 22 is able to move in the axial direction and also be able to tilt. In the spherical surface portions B and C, the outer cutter 22 is able to tilt. The cylindrical portion A and the spherical surface portions B and C are designed with a consideration that the length of the cylindrical portion A and curvatures of the spherical surface portions B and C meet the requirement of the vertical movement stroke and tilting angle range of the outer cutter 22.

Figure 3A:
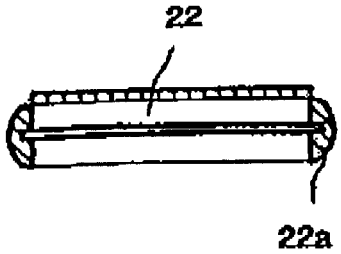
FIGS. 3(*a*) and 3(*b*) are explanatory diagrams that show examples in which the outer surface of the outer cutter is formed as a spherical surface.
Figure 3B:
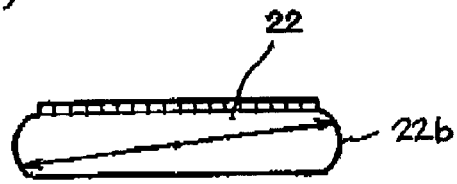

FIGS. 3(*a*) and 3(*b*) illustrate the modifications of outer cutters 22 that have outer surfaces formed so as to have spherical surfaces. FIG. 3(*a*) shows an example that uses a conventional metal outer cutter. A resin molded section 22*a* whose outer surface is formed as a spherical surface is integrally molded on the outer surface of stainless steel outer cutter 22 by a synthetic resin insert molding method. With the insert molding that uses a synthetic resin, the outer surface of the resin molded section 22*a* can be formed spherically easily, and also such outer surface can be formed into curved surface with a desired curvature. Furthermore, the synthetic resin molding is also advantageous in that the conventional outer cutters 22 can be used "as is". Moreover, since the cutter frame 30 is formed by synthetic resin molding, it is also easy to form the shape of the inner surface of the outer cutter hole 44 as appropriately curved surface.

In the example shown in FIG. 3(*b*), the outer surface of the outer cutter 22 is formed as a spherical surface by metal working when the outer cutter 22 is manufactured. The outer cutters 22 with their outer surfaces 22*b* formed as spherical surfaces are advantageous in that the outer cutters 22 can be manufactured by metal working alone.

Figure 4A:
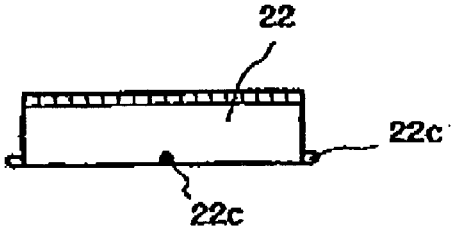
FIGS. 4(*a*) and 4(*b*) show a front view and a plan view respectively that illustrate the structure of the outer cutter in the second embodiment of the electric rotary shaver of the present invention.
Figure 4B:
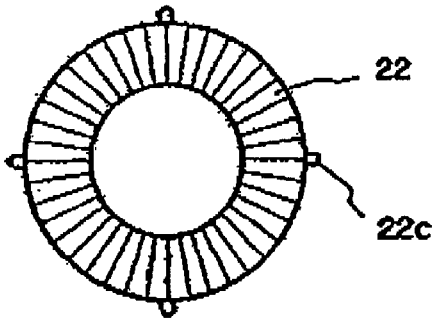

FIGS. 4(*a*), 4(*b*) and 5 show the structure of the second embodiment of the present invention for supporting the outer cutters 22 in the cutter frame 30 of the cutter head.

Figure 5:
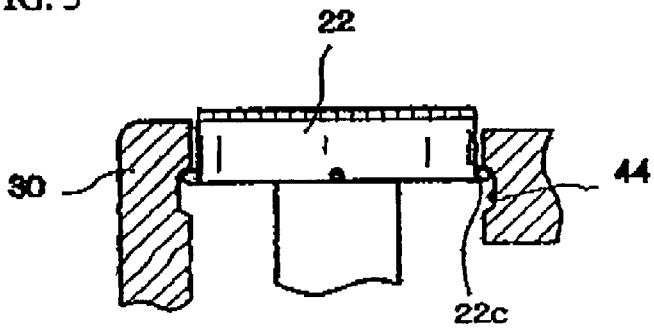
FIG. 5 is an explanatory diagram that illustrates the structure of the outer cutter and the cutter frame of the second embodiment.

This embodiment is characterized in that ribs 22*c* are formed so that these ribs protrude outward from the outer surface of each one of the outer cutters 22 as shown in FIGS. 4(*a*) and 4(*b*); and as shown in FIG. 5 the outer cutter 22 with ribs 22*c* is arranged so that the end portions of the ribs 22*c* and the inner surface of one of the outer cutter holes 44 of the cutter frame 30 make a sliding contact with each other. As in the case shown in FIG. 2, the inner surface of the outer cutter hole 44 has a cylindrical portion in the intermediate portion thereof, and spherical surface portions are formed above and below the cylindrical portion. Thus, the outer cutter 22 moves in the axial direction and tilts in any desired direction.

In all of the embodiments described above, the outer cutters 22 are supported so that the rotation thereof is prevented in the cutter frame 30. In the embodiment of FIGS. 4 and 5 in which each of the outer cutters 22 is supported in the cutter frame 30 via ribs 22*c* that protrude from the outer surface of the outer cutter 22, only guide grooves are formed in the cutter frame 30 so that the grooves that engage the ribs have the length that allows the movement of the ribs 22*c* in the axial direction. In this structure, the outer cutter holes 44 are formed so that the edge of each of the outer cutter holes 44 runs not entirely around the circumference of each of the outer cutters 22. In this rib and guide groove structure, the guide grooves act to prevent circumferential rotation of the outer cutters 22. The intermediate portion of each guide groove is formed in a rectilinear shape, and the upper and lower portions of the guide groove are formed in a circular arc shape. Thus, the outer cutters 22 can be moved in the axial direction and can tilt in any desired direction Furthermore, in the embodiment in which the outer cutters 22 are formed with protruding ribs 22*c* so that the outer cutters 22 are guided in the outer cutter holes 44 via the ribs 22*c*, it is preferable to form at least three ribs 22*c* at equal intervals in the circumferential direction of each outer cutter 22 so that each outer cutter 22 is supported at three-points. Thus, the outer cutters 22 are supported in a stable fashion regardless of the tilting direction of the outer cutters 22. In deed, there is no restriction in regards to the number of ribs 22*c*. As many ribs as more than five ribs can be formed.

Figure 6:
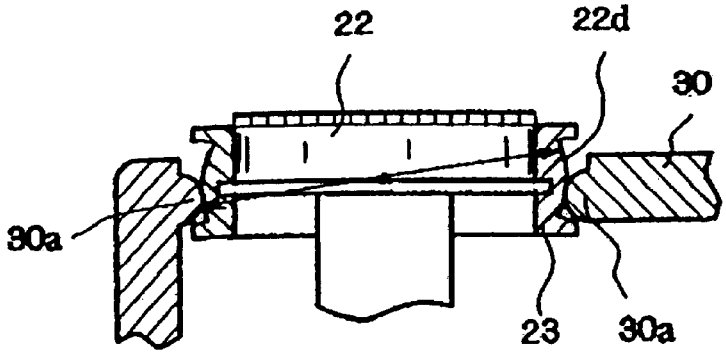
FIG. 6 is an explanatory diagram that illustrates the structure of the outer cutter and the cutter frame of the third embodiment of the present invention.

FIG. 6 shows still another structure according to the third embodiment of the present invention for supporting the outer cutters 22 in the cutter frame 30 of the cutter head.

As described in the respective embodiments above, the electric rotary shaver to which the present invention is applied has a structure in which the outer cutters 22 and cutter frame 30 are constructed so that the outer surfaces of the outer cutters 22 and the inner surfaces of the outer cutter holes 44 in the cutter frame 30 make a sliding contact with each other, thus allowing the outer cutters 22 to tilt and move in the axial direction. Accordingly, various configurations of sliding contact between the outer surfaces of the outer cutters 22 and inner surfaces of the outer cutter holes 44 can be adopted.

In the embodiment of FIG. 6, a protruding portion 30*a* is formed on the inner surface of each one of the outer cutter holes 44, and recessed surfaces 22*d* are formed in the outer surface of each one of the outer cutters 22 so as to be above and below the protruding portion 30*a*. The recessed surfaces 22*d* are formed so as to be inside the edge of the outer surface of the outer cutter 22, thus forming a barrel-form outer surface. With such shapes of the outer surfaces of the outer cutters 22 and of the inner surfaces of the outer cutter holes 44, the outer cutters 22 can tilt in any desired direction.

In this embodiment, in order to form recessed surfaces 22*d* that have barrel-form sliding contact surfaces in the outer surfaces of the outer cutters 22, a resin molded section 23 is integrally formed on each of the outer cutters 22 by resin molding, and recessed surfaces 22*d* are formed in the outer surface of the resin molded section 23. With the resin molding, the outer surfaces of the resin molded sections 23 can be easily formed into curved surfaces of an appropriate shape.

In the above embodiments, the outer cutters 22 are provided in a stable fashion without looseness so that the outer cutters 22 tilt to a considerable degree by supporting the outer cutters 22 in a sliding contact structure with reference to the cutter frame 30. Such a structure of supporting the outer cutters 22 in the cutter frame 30 can be applied to electric rotary shavers of various types in which the outer cutters are supported in a floating fashion. Furthermore, in the above embodiment, compared to the conventional electric shavers, an increased angular range through which the outer cutters 22 can tilt is assured, and the outer cutters 22 can be securely held without looseness. Accordingly, the outer cutters appropriately fit against the skin without any deleterious effects on the rotation of the inner cutters, etc., and an easy-to-use electric shaver with a good cutting efficiency can be provided.

As seen from the above, according to the electric rotary shaver of the present invention, the outer cutters can tilt smoothly without looseness as a result of the outer cutters being supported with their outer surfaces in a sliding contact with the outer cutter holes of the cutter frame. Accordingly, the fit between the skin and the outer cutters is improved, and the convenience of the electric shaver is further improved. In addition, since the outer cutters can smoothly tilt and perform a floating motion, a smooth driving of the inner cutters, etc. is assured, and a good cutting efficiency etc. can be obtained.

What is claimed is:

1. An electric rotary shaver comprising:

a cutter frame provided with outer cutter holes, and outer cutters each of which being fitted in each of said outer cutter holes so as to be supported and movable in an axial direction thereof and tiltable in any desired direction with inner cutters provided between said outer cutters and inner cutter drive shafts, said drive shafts being urged toward outside in an axial direction thereof for biasing said inner cutters into contact with said outer cutters; wherein outer surfaces of said outer cutters and inner surfaces of said outer cutter holes are formed so as to make a sliding contact, thus supporting said outer cutters to tilt in any desired direction in said outer cutter holes;

said outer cutters make said sliding contact with said inner surfaces of said outer cutter holes so that the outer cutters can move in an axial direction while always maintaining sliding contact with said inner surface of said outer cutter holes; and said outer surfaces of said outer cutters are formed in a spherical surface shape that protrudes outward and said inner surfaces of said outer cutter holes comprise a pair of opposing spherical surfaces at each end of said outer cutter holes with a cylindrical surface provided between said pair of opposing spherical surfaces.

2. The electric rotary shaver according to claim 1, wherein said outer surfaces of said outer cutters and said inner surfaces of said outer cutter holes make said sliding contact at three or more points, thus supporting said outer cutters in said cutter frame so that said outer cutters can tilt in any desired direction.

3. The electric rotary shaver according to claim 1 or 2, wherein said outer cutters comprise metallic outer cutter members and resin molded sections whose outer surfaces make said sliding contact with said inner surfaces of said outer cutter holes integrally resin-molded on said metallic outer cutter members.

4. The electric rotary shaver according to claim 1 or 2, wherein a diameter of each end of said outer cutter holes is less than a diameter of said cylindrical surface.

5. The electric rotary shaver according to claim 4, wherein the diameter of said cylindrical surface is substantially equal to the diameter of said outer cutter.

* * * * *